US006599046B2

(12) United States Patent
Fukushima et al.

(10) Patent No.: US 6,599,046 B2
(45) Date of Patent: Jul. 29, 2003

(54) DIRECT LIQUID TYPE WRITING INSTRUMENT

(75) Inventors: Makoto Fukushima, Kawagoe (JP); Yoshio Noguchi, Kawagoe (JP)

(73) Assignee: Kotobuki & Co., Ltd., Kyoto (JP)

( * ) Notice: Subject to any disclaimer, the term of this patent is extended or adjusted under 35 U.S.C. 154(b) by 0 days.

(21) Appl. No.: 10/303,034

(22) Filed: Nov. 25, 2002

(65) Prior Publication Data

US 2003/0099501 A1 May 29, 2003

(30) Foreign Application Priority Data

Nov. 26, 2001 (JP) ..... 2001-359693

(51) Int. Cl.[7] ..... B43K 5/08; B43K 5/10; B43K 8/04

(52) U.S. Cl. ..... 401/206; 401/148; 401/151

(58) Field of Search ..... 401/148, 151, 401/177, 179, 180, 198, 206

(56) References Cited

U.S. PATENT DOCUMENTS 5,035,524 A * 7/1991 Sakurai ..... 401/206

5,362,168 A * 11/1994 Abe et al. ..... 401/206

* cited by examiner

*Primary Examiner*—Gregory L. Huson
*Assistant Examiner*—Kathleen J. Prunner
(74) *Attorney, Agent, or Firm*—McGinn & Gibb, PLLC

(57) ABSTRACT

A direct liquid type writing instrument is used without running-over of ink even in an environment in which an internal pressure is higher than an external pressure. The writing instrument includes an ink reservoir containing ink, a junction core extending on a center axis, and a pen body provided integrally on a tip end side of the junction core. The ink reservoir includes a main ink reservoir, a pen core chamber in which the junction core is disposed, and a sub ink reservoir which is provided between the main ink reservoir and the pen core chamber and communicates with the main ink reservoir via a small hole. Between the sub ink reservoir and the pen core chamber, an opening/closing valve is provided to normally isolate the pen core chamber from the sub ink reservoir and to be operated so that the pen core chamber communicates with the sub ink reservoir when the pen body is operated. An ink absorption body capable of absorbing ink is provided in the pen core chamber, and a rod portion, being an ink suction body, which can moves into the small hole is provided at a rear of the opening/closing valve.

8 Claims, 7 Drawing Sheets

DIRECT LIQUID TYPE WRITING INSTRUMENT

BACKGROUND OF THE INVENTION

1. Field of the Invention

The present invention relates to a direct liquid type writing instrument provided with an ink reservoir containing ink.

2. Description of the Related Art

A conventional direct liquid type writing instrument of this type includes an ink reservoir containing ink, a junction core extending on a center axis in front of the ink reservoir, and a pen body provided on a tip end side of the junction core.

A problem with the conventional direct liquid type writing instrument constructed as described above is that when the instrument is used in an environment in which air pressure changes, for example, an internal pressure is higher than an external pressure as within an aircraft, ink contained in the ink reservoir runs over from a pen tip, whereby a paper surface is stained.

SUMMARY OF THE INVENTION

The present invention has been achieved to solve the above problem, and accordingly an object thereof is to provide a direct liquid type writing instrument which can be used as usual without running-over of ink even in an environment in which the internal pressure is higher than the external pressure.

To attain the above object, a direct liquid type writing instrument according to the present invention comprises, an ink reservoir including a main ink reservoir containing ink, a pen core chamber, and a sub ink reservoir which is provided between said main ink reservoir and said pen core chamber and communicates with said main ink reservoir via a small hole; a junction core disposed in said pen core chamber and extending on a center axis; a pen body provided integrally with a tip end side of said junction core or separately so as to be in contact with the tip end of said junction core; an opening/closing valve provided between said sub ink reservoir and said pen core chamber to normally isolate said pen core chamber from said sub ink reservoir and to be operated so that said pen core chamber communicates with said sub ink reservoir when said pen body is operated; an ink absorption body capable of absorbing ink, provided in said pen core chamber; and an ink suction body provided in said sub ink reservoir for moving into said small hole in association with an operation of said opening/closing valve.

When the writing instrument is first used, the pen body is operated to open the opening/closing valve, by which the pen core chamber is caused to communicate with the sub ink reservoir. At the same time, the ink suction body is moved into the small hole located between the main ink reservoir and the sub ink reservoir in association with the operation of the opening/closing valve. Thereby, the ink in the main ink reservoir is sucked into the sub ink reservoir and is further supplied into the pen core chamber communicating with the sub ink reservoir so that the ink is absorbed by the junction core and the ink absorption body in the pen core chamber. Thus, ink spreads over the pen body, by which writing can be made possible.

When writing is performed, since the operation of the pen body is released, the opening/closing valve isolates the pen core chamber from the sub ink reservoir, and also the ink suction body returns into the sub ink reservoir. Writing can be continued without the operation of the pen body until the ink absorbed by the ink absorption body is consumed. When the writing line becomes faint, the pen body is operated again, by which ink is sucked from the main ink reservoir as before, being supplied into the pen core chamber, and is absorbed by the junction core and the ink absorption body in the pen core chamber.

Even when the writing instrument is used in an environment in which the internal pressure is higher than the external pressure, since the pen core chamber is isolated from the sub ink reservoir and the main ink reservoir by the opening/closing valve, the ink sent from the sub ink reservoir and the main ink reservoir does not run over to the outside, and writing can be performed with the pen body using the ink absorbed by the ink absorption body in the pen core chamber. When the writing line becomes faint, the pen body is operated to open the opening/closing valve to supply the ink sucked from the main ink reservoir from the sub ink reservoir to the pern core chamber. At this time, even if the opening/closing valve causes the pen core chamber to communicate with the sub ink reservoir, the ink sent from the sub ink reservoir is instantly absorbed by the ink absorption body, so that ink does not run over from the pen body. When the ink is desired to be supplied, the ink suction body sucks ink from the main ink reservoir, so that the ink from the main ink reservoir can be supplied surely to the pen body.

Preferably, the small hole can have a diameter of 0.3 to 3.0 mm. Thereby, a natural flow of ink from the main ink reservoir to the sub ink reservoir can be prevented by the surface tension of ink. The diameter of the small hole is preferably 1.0 to 2.0 mm.

The ink absorption body can be formed of any substance capable of absorbing ink. Preferably, the ink absorption body is formed of a porous substance. Thus, the ink absorption body can absorb a high capacity of ink, and therefore the quantity of ink that can be used in writing by one operation of the pen body can be increased.

The ink suction body can be formed with a plurality of capillary grooves on an outer peripheral surface thereof, and the capillary groove has a size capable of sucking ink from the main ink reservoir by a capillary force. Thus, by utilizing the capillary force, the ink suction body can suck ink surely from the main ink reservoir.

The present disclosure relates to subject matter contained in Japanese Patent Application No. 2001-359693, filed on Nov. 26, 2001, which are expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF THE PREFERRED EMBODIMENTS

Figure 1:
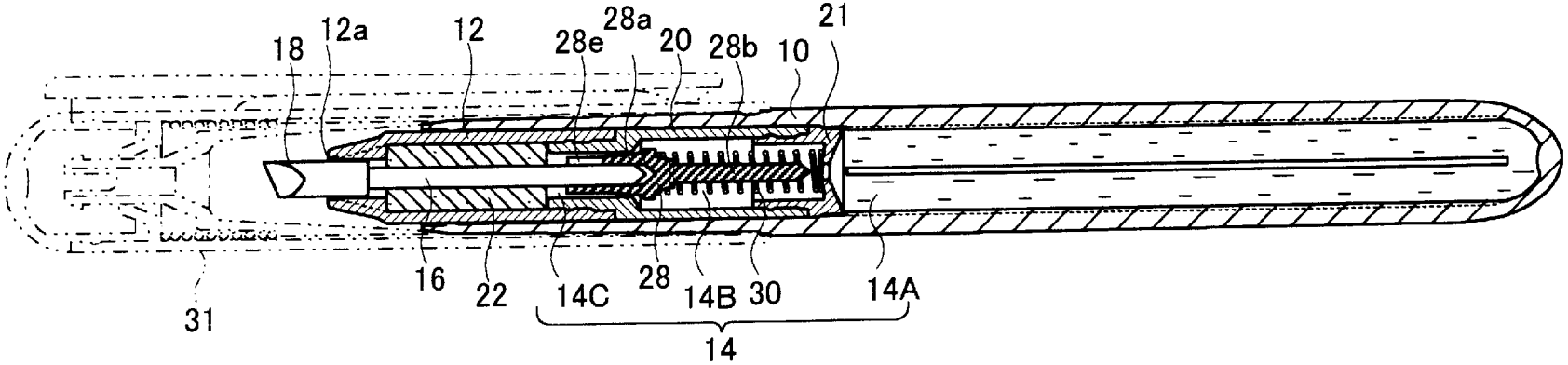
FIG. 1 is a general longitudinal sectional view showing an embodiment of a direct liquid type writing instrument in accordance with the present invention.
Figure 2:
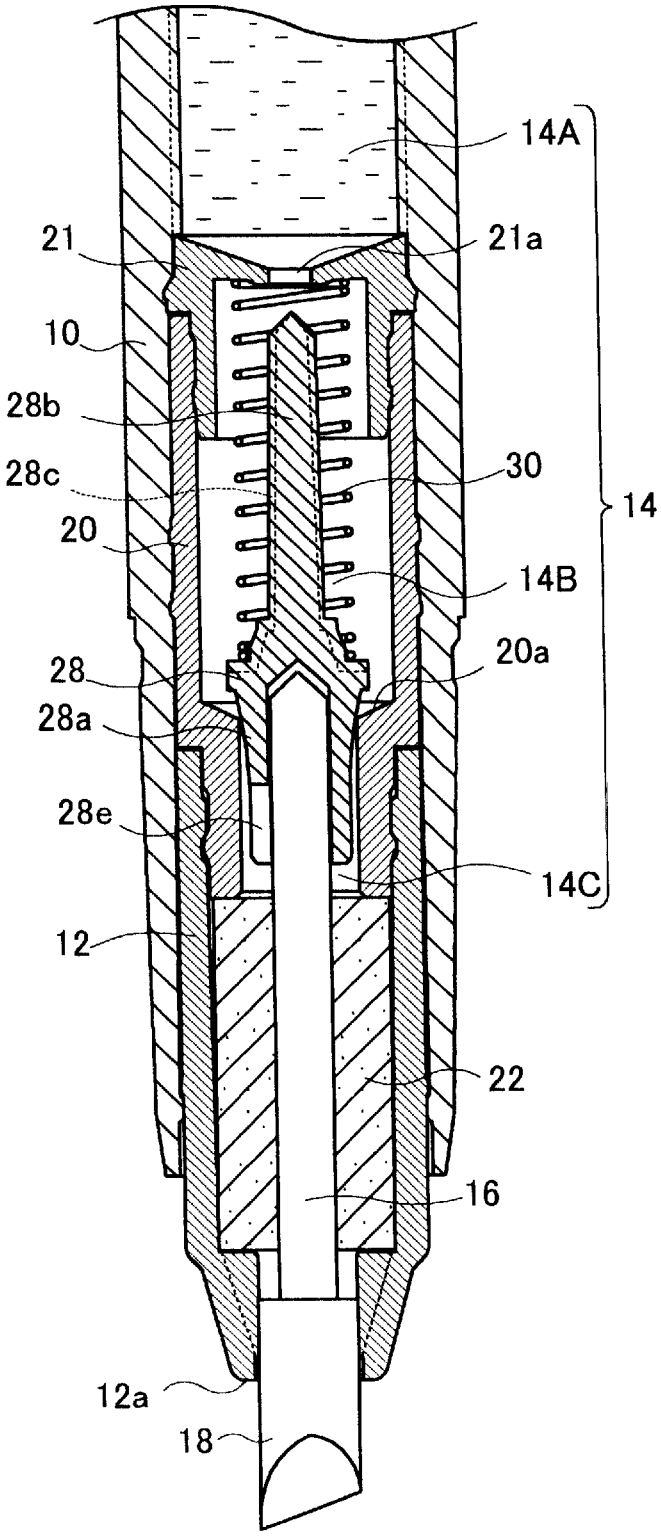
FIG. 2 is an enlarged longitudinal sectional view of a tip end portion of the direct liquid type writing instrument shown in FIG. 1.

Embodiments of the present invention will now be described with reference to the accompanying drawings. FIG. 1 is a longitudinal sectional view showing an embodiment of a direct liquid type writing instrument in accordance with the present invention. In FIG. 1, the direct liquid type writing instrument has a barrel 10, and in a tip end portion of the barrel 10 is installed a tip member 12. A tip end portion of the tip member 12 is tapered, and an end hole 12*a* is formed at the tip end thereof. An interior of the barrel 10 and the tip member 12 forms an ink reservoir 14. A junction core 16 extends on a center axis of the writing instrument, and a tip end of the junction core 16 forms a pen body 18 protruding from the end hole 12*a*. In this example, the junction core 16 and the pen body 18 are formed as an integral element. However, these elements may be formed as separate elements, and the tip end of the junction core 16 may be connected to the pen body 18, or a tip end face of the junction core 16 may merely be caused to be in contact with a rear end face of the pen body 18. Also, the junction core 16 and the pen body 18 can be formed of a material such as felt.

A tip end portion of an intermediate sleeve 20 is pressed in and fixed to a rear end portion of the tip member 12, and further a tail plug 21 is pressed in and fixed to a rear end portion of the intermediate sleeve 20. The tip member 12, the intermediate sleeve 20, and the tail plug 21 form a mechanism unit, and this unit is pressed in and fixed in the barrel 10. In this mechanism unit, an opening/closing valve 28 connected to the junction core 16 is arranged so as to be movable in a reciprocating manner. The opening/closing valve 28 is normally urged against a valve seat portion 20*a* provided on the intermediate sleeve 20 by a return spring 30.

The ink reservoir 14 includes a main ink reservoir 14A which is located at a rear of the mechanism unit and can contain a high capacity of ink in a liquid phase state, a sub ink reservoir 14B formed by the intermediate sleeve 20 and the tail plug 21 of the mechanism unit, and a pen core chamber 14C formed by the tip member 12 and the tip end portion of the intermediate sleeve 20. The sub ink reservoir 14B and the pen core chamber 14C are partitioned by the opening/closing valve 28. The sub ink reservoir 14B and the main ink reservoir 14A are partitioned by the tail plug 21. In a central portion of the tail plug 21 is formed a small hole 21*a* which allows the sub ink reservoir 14B to communicate with the main ink reservoir 14A. The small hole has a diameter of 0.3 to 3.0 mm, preferably about 1.0 to 2.0 mm. Therefore, since air does not pass through the small hole 21*a* due to a surface tension of ink, ink is prevented from flowing naturally from the main ink reservoir 14A to the sub ink reservoir 14B through the small hole 21*a*.

As shown in FIG. 4, the opening/closing valve 28 is formed with a receiving bore 28*d* extending on a center axis from the tip end face of the valve. In the receiving bore 28*d*, the rear end portion of the junction core 16 is inserted. Thereby, the opening/closing valve 28 is integrally connected to the junction core 16 and the pen body 18.

Also, in a central portion of the opening/closing valve 28, there is formed a valve element portion 28*a* which comes into contact with the valve seat portion 20*a* of the intermediate sleeve 20. An outer peripheral surface of the valve element portion 28*a* forms a closing seal surface of a tapered shape such that the diameter increases gradually toward the rear. Therefore, the valve element portion 28*a* comes surely into contact with the valve seat portion 20*a*, so that the pen core chamber 14C can be isolated from the sub ink reservoir 14B.

Figure 5A:
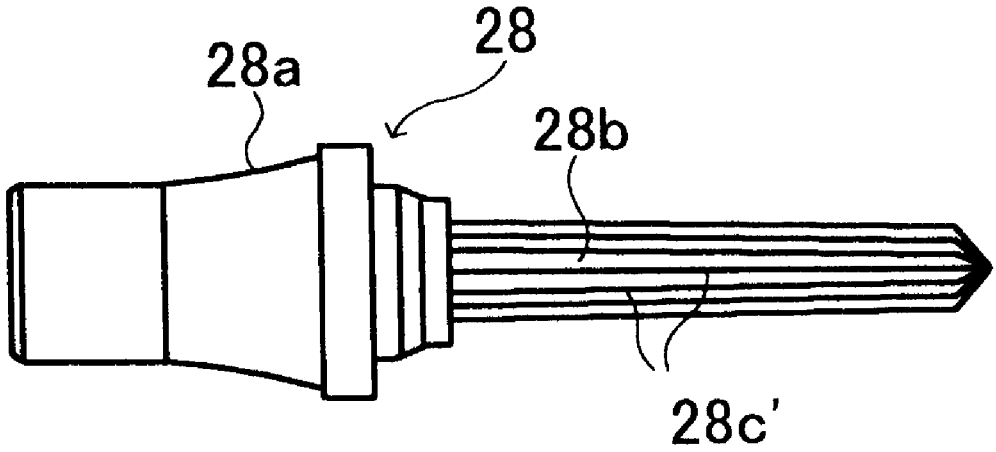
FIG. 5A is a plan view showing another example of an opening/closing valve.
Figure 5B:
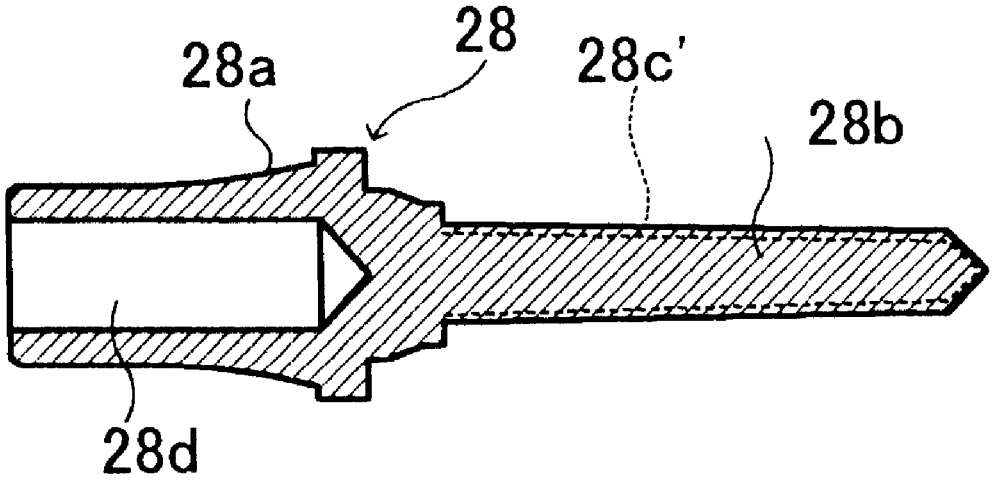
FIG. 5B is a longitudinal sectional view of the opening/closing valve shown in FIG. 5A.
Figure 6:
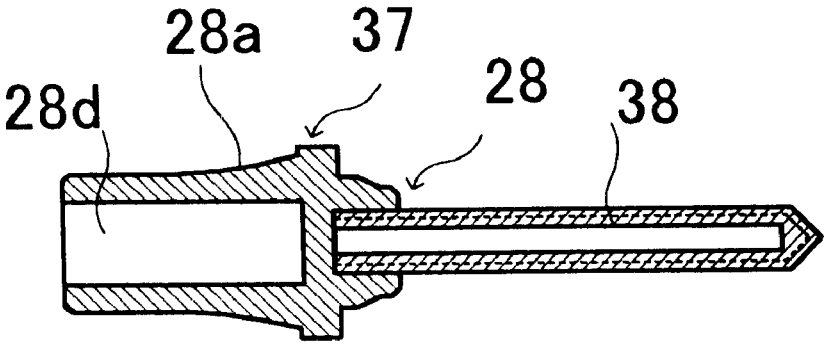
FIG. 6 is a longitudinal sectional view showing still another example of an opening/closing valve.

Further, in a rear portion of the opening/closing valve 28, there is formed a rod portion 28*b* (ink suction body) extending toward a rear in the sub ink reservoir 14B so that a rear end of the rod portion 28*b* gets into the small hole 21*a* in the tail plug 21 when the opening/closing valve 28 moves to the rearmost position. On a peripheral surface of the rod portion 28*b* are formed many capillary grooves 28*c* extending in a lengthwise direction. The groove width of the capillary groove 28*c* is set to a dimension such that ink can flow through the capillary groove 28*c* by the capillary force. The capillary grooves 28*c* serve to suck the ink coming from the main ink reservoir 14A into the sub ink reservoir 14B, and further convey the ink into the pen core chamber 14C. For this purpose, it is desirable that the capillary grooves 28*c* extend from the rear end of the rod portion 28*b* to a position closest possible to the valve element portion 28*a*. However, as shown in FIG. 5, the capillary grooves 28*c* ' may be formed in the rod portion 28*b* only. Also, as shown in FIG. 6, the ink suction body, which is the rod portion, can be formed by a part different from a part 37 having another elements, such as valve element portion 28*a* etc. For example, it can be formed by a hollow core 38. This hollow core 38 may be connected integrally to the part 37 by being pressed in and fixed to the part 37 (alternatively, the part 37 may be pressed in and fixed to the hollow core 38).

In the tip end portion of the opening/closing valve 28, there is formed a capillary slit 28*e* cut in a radial direction from the receiving bore 28*d*. In the example shown in the drawing, one capillary slit 28*e* is formed, but a plurality of capillary slits 28*e* can be formed in the radial direction. Thereby, the ink having moved into the sub ink reservoir 14B can further be conveyed to the junction core 16 through the capillary slit 28*e*.

Figure 7:
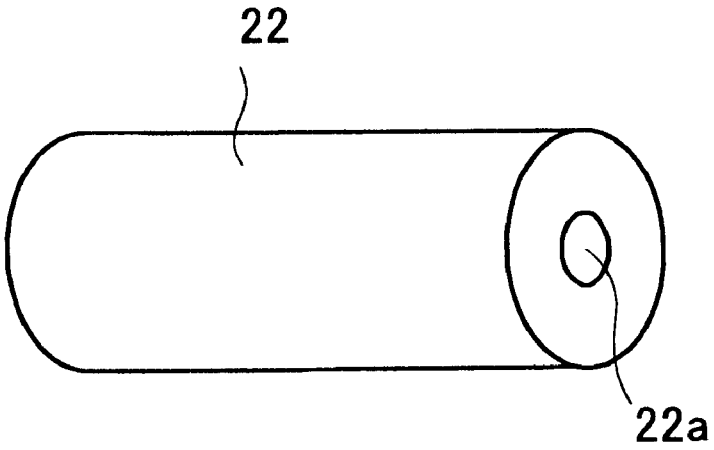
FIG. 7 is a perspective view of an ink absorption body.

In the pen core chamber 14C, the junction core 16 is disposed on a center axis of the pen core chamber 14*c*. Around the junction core 16 is provided an ink absorption body 22. As shown in FIG. 7, the ink absorption body 22 is of a cylindrical shape, and a through hole 22*a* through which the junction core 16 is inserted is formed on the center axis thereof. The ink absorption body 22 is preferably formed of a material having porosity such that ink can be absorbed efficiently and hence a high capacity of ink can be absorbed, such as cotton and sponge.

In the tip end portion of the barrel 10, a cap 31 (indicated by an imaginary line in FIG. 1) is detachably mounted to protect the pen body 18 and to prevent evaporation of ink and drying of the pen body 18 when the writing instrument is not used.

Figure 3:
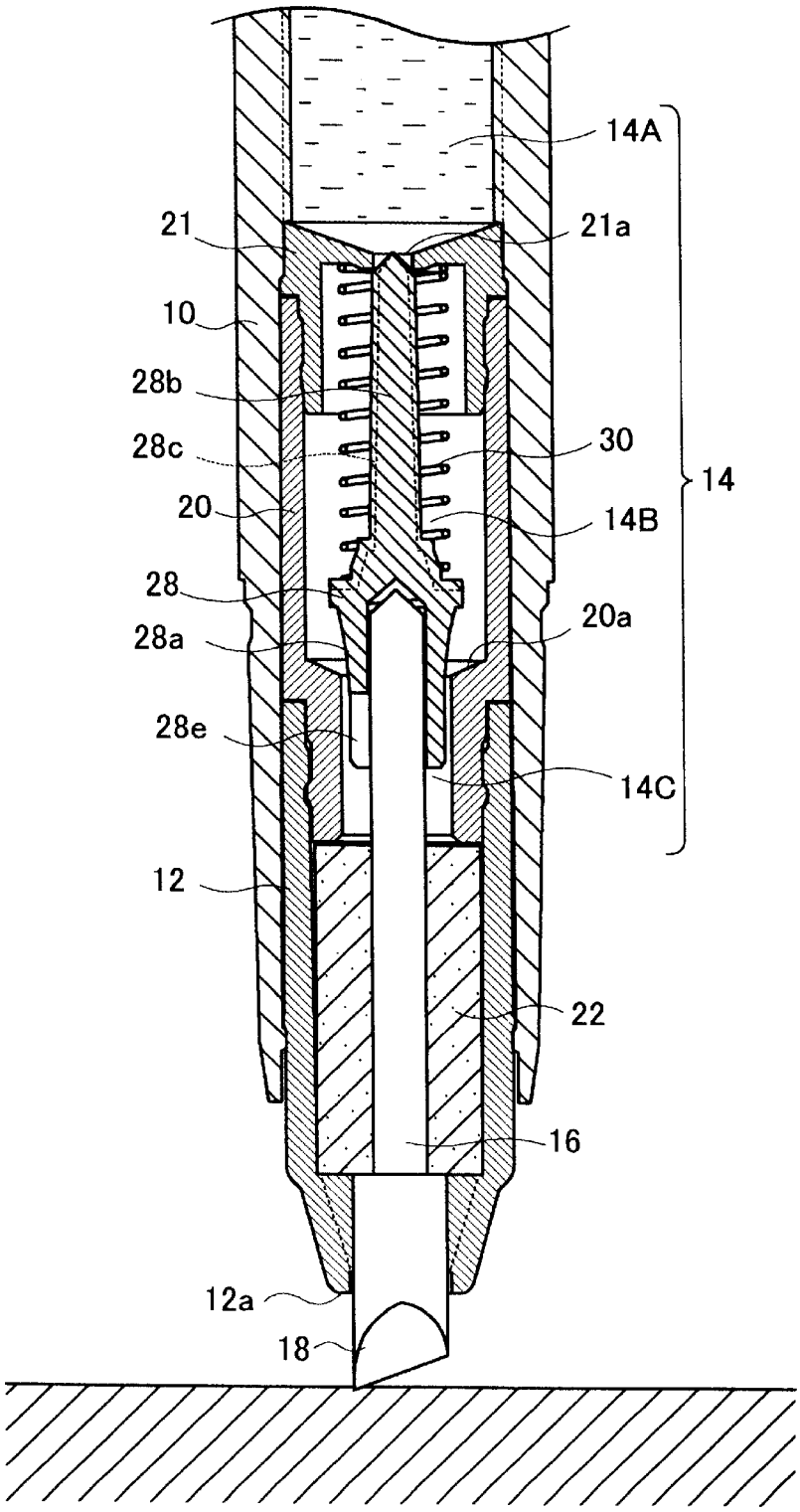
FIG. 3 is a sectional view corresponding to FIG. 2, showing a state in which a pen body is pressed on a paper surface.
Figure 4A:
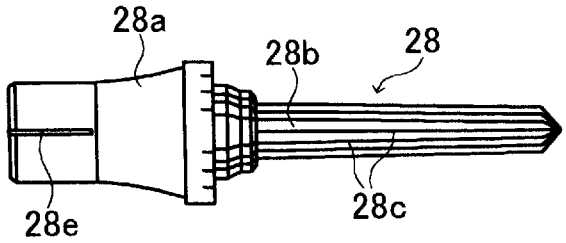
FIG. 4A is a plan view of an opening/closing valve.
Figure 4B:
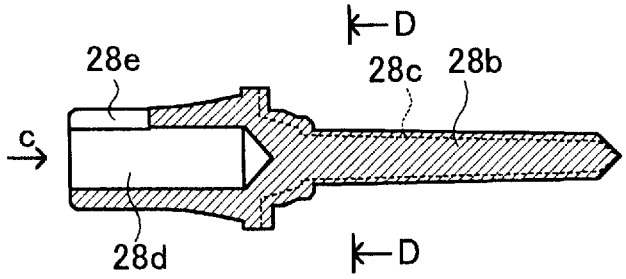
FIG. 4B is a longitudinal sectional view of the opening/closing valve shown in FIG. 4A.
Figure 4C:
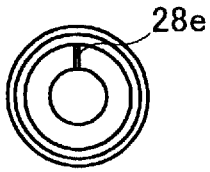
FIG. 4C is a view taken in a direction of an arrow C of FIG. 4B.
Figure 4D:
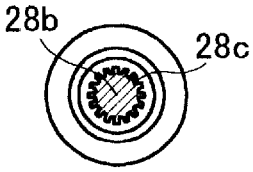
FIG. 4D is a sectional view taken along a line D—D of FIG. 4B.

The operation of the direct liquid writing instrument constructed as described above will be explained. When the direct liquid writing instrument is first used, the cap 31 is removed, and the tip end of the pen body 18 is pressed on a paper surface. Thus, as shown in FIG. 3, the opening/closing valve 28 moves rearward together with the pen body 18 and the junction core 16 against the pressing force of the return spring 30. Thereby, the rod portion 28*b*, which is integral with the opening/closing valve 28, is also retreated, and the rear end thereof gets into the center hole 21*a* in the tail plug 21 and somewhat enters the main ink reservoir 14A, coming into contact with the ink in the main ink reservoir 14A. Thereby, the ink in the main ink reservoir 14A is sucked into the capillary grooves 28*c* formed in the rod portion 28*b*. The sucked ink passes through the capillary grooves 28*c*, and is sent into the sub ink reservoir 14B. Further, at this time, the pen core chamber 14C is caused to communicate with the sub ink reservoir 14B by the retreat of the opening/closing valve 28, so that the ink sent into the sub ink reservoir 14B is sent into the pen core chamber 14C. In the case where the capillary slit 28*e* is formed, the ink in the sub ink reservoir 14B is sucked by the capillary slit 28*e* and is supplied to the junction core 16.

The ink sent into the pen core chamber 14C is absorbed by the junction core 16, and other ink is absorbed by the ink absorption body 22. The ink absorbed by the junction core 16 is conveyed to the pen body 18. Thus, by pressing the tip end of the pen body 18 on the paper surface, ink is sent from the main ink reservoir 14A to the sub ink reservoir 14B and to the pen core chamber 14C, being fully absorbed by the junction core 16 and the ink absorption body 22 in the pen core chamber 14C, and also spreads in the pen body 18, by which writing can be made possible. After the pressing of the tip end of the pen body 18 on the paper surface is released, writing can be performed by using the pen body 18. The writing can be continued without pressing until a quantity of ink corresponding to the quantity of ink absorbed by the ink absorption body 22 is consumed. When the writing line becomes faint, the pen body 18 is pressed again on the paper surface. Thereby, the ink in the main ink reservoir 14A is supplied into the pen core chamber 14C, and the ink is absorbed by the junction core 16 and the ink absorption body 22 in the pen core chamber 14C, by which the pen body is filled with ink, which again makes writing possible.

In the case where the direct liquid type writing instrument of this embodiment is used under an environment in which the internal pressure is higher than the external pressure, even if the cap 31 is removed, ink does not run over, and writing can be continued satisfactorily. The reason for this is that writing can be performed by the ink absorbed by the ink absorption body 22 in the pen core chamber 14C, and since the sub ink reservoir 14C is isolated from the main ink reservoir 14A and the sub ink reservoir 14B by the opening/closing valve 28, ink does not run over from these ink reservoirs 14A and 14B to the outside. Even if the writing line becomes faint and thus the pen body 18 must be pressed on the paper surface to open the opening/closing valve 28, the ink running over from the main ink reservoir 14A and the sub ink reservoir 14B is absorbed instantly by the ink absorption body 22 in the pen core chamber 14C. This is because the opening operation of the opening/closing valve 28 is performed in a state in which the ink absorbed by the ink absorption body 22 has been used up and the ink in the ink absorption body 22 has been exhausted. Therefore, ink is prevented from running over to the tip end of the pen body 18.

Thus, the ink absorption body 22 has both a role in storing the ink supplied from the main ink reservoir 14A and a role in absorbing and storing the ink running over from the main ink reservoir 14A and the sub ink reservoir 14B, the running-over of ink possibly occurring when the pressure changes.

Figure 8:
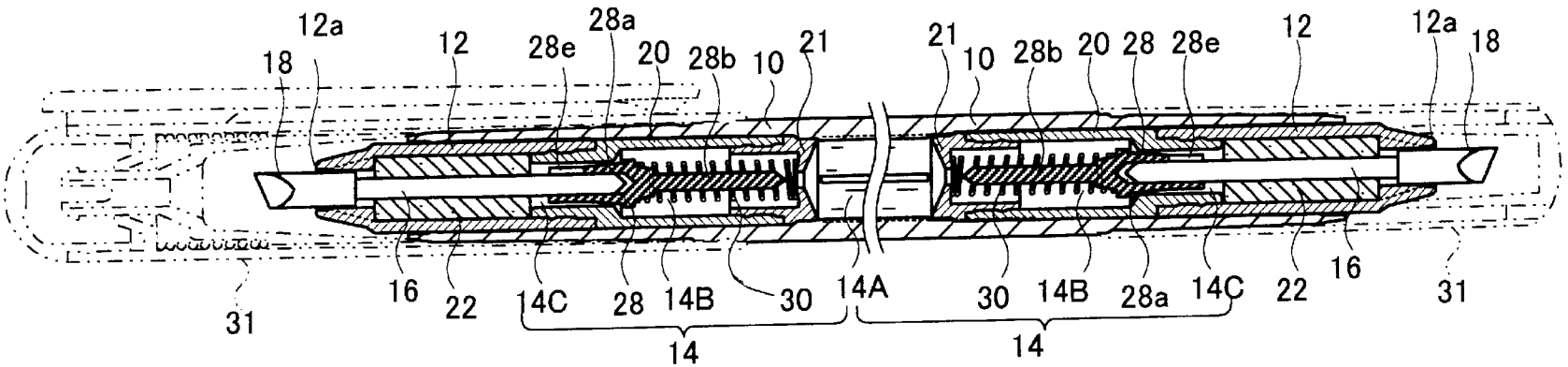
FIG. 8 is a general longitudinal sectional view showing another embodiment of a direct liquid type writing instrument in accordance with the present invention.

FIG. 8 is a general longitudinal sectional view showing another embodiment of a direct liquid type writing instrument in accordance with the present invention. The direct liquid type writing instrument of this embodiment differs from that of the first embodiment in that this is made of a double end type. Specifically, in the direct liquid type writing instrument of the second embodiment, the tip members 12, 12 are pressed in and fixed to both end portions of the barrel 10, and two junction cores 16 extend on the center axis of the writing instrument. The tip end of each of the junction cores 16 forms the pen body 18 protruding from the end hole 12*a* of each of the tip member 12. The pen bodies 18, 18 may have a different size or shape. The ink reservoirs 14 each have the sub ink reservoir 14B and the pen core chamber 14C except that the main ink reservoir 14A is common. The operation in each end portion is the same as that of the case shown in FIG. 1, and therefore the explanation thereof is omitted. This embodiment also achieves the same operation and effect as those of the first embodiment.

As described above, according to the present invention, even when the writing instrument is used under an environment in which the internal pressure is higher than the external pressure, since the pen core chamber is isolated from the sub ink reservoir and the main ink reservoir by the opening/closing valve, the ink sent from the sub ink reservoir and the main ink reservoir does not run over to the outside, and writing can be performed with the pen body using the ink absorbed by the ink absorption body in the pen core chamber. When the writing line becomes faint, the pen body is operated to open the opening/closing valve to supply the ink sucked from the main ink reservoir from the sub ink reservoir to the pen core chamber. At this time, even if the opening/closing valve causes the pen core chamber to communicate with the sub ink reservoir, the ink sent from the sub ink reservoir is instantly absorbed by the ink absorption body, so that ink does not run over from the pen body. When the ink is desired top be supplied, the ink suction body sucks ink from the main ink reservoir, so that the ink from the main ink reservoir can be supplied surely to the pen body.

While the invention has been described in terms of several preferred embodiments, those skilled in the art will recognize that the invention can be practiced with modification within the spirit and scope of the appended claims.

What is claimed is:

1. A direct liquid type writing instrument comprising:

an ink reservoir including a main ink reservoir containing ink, a pen core chamber, and a sub ink reservoir which is provided between said main ink reservoir and said pen core chamber and communicates with said main ink reservoir via a small hole;

a junction core disposed in said pen core chamber and extending on a center axis;

a pen body provided integrally with a tip end side of said junction core or separately so as to be in contact with the tip end of said junction core;

an opening/closing valve provided between said sub ink reservoir and said pen core chamber to normally isolate said pen core chamber from said sub ink reservoir and to be operated so that said pen core chamber communicates with said sub ink reservoir when said pen body is operated;

an ink absorption body capable of absorbing ink, provided in said pen core chamber; and an ink suction body provided in said sub ink reservoir for moving into said small hole in association with an operation of said opening/closing valve.

2. The direct liquid type writing instrument according to claim 1, wherein said small hole has a diameter of 0.3 to 3.0 mm.

3. The direct liquid type writing instrument according to claim 2, wherein said ink absorption body has porosity.

4. The direct liquid type writing instrument according to claim 3, wherein said ink suction body is formed with a plurality of capillary grooves on an outer peripheral surface thereof, and said capillary grooves have a size capable of sucking ink from said main ink reservoir by a capillary force.

5. The direct liquid type writing instrument according to claim 2, wherein said ink suction body is formed with a plurality of capillary grooves on an outer peripheral surface thereof, and said capillary grooves have a size capable of sucking ink from said main ink reservoir by a capillary force.

6. The direct liquid type writing instrument according to claim 1, wherein said ink absorption body has porosity.

7. The direct liquid type writing instrument according to claim 6, wherein said ink suction body is formed with a plurality of capillary grooves on an outer peripheral surface thereof, and said capillary grooves have a size capable of sucking ink from said main ink reservoir by a capillary force.

8. The direct liquid type writing instrument according to claim 1, wherein said ink suction body is formed with a plurality of capillary grooves on an outer peripheral surface thereof, and said capillary grooves have a size capable of sucking ink from said main ink reservoir by a capillary force.

* * * * *